US005092387A

United States Patent [19]

King et al.

[11] Patent Number: 5,092,387

[45] Date of Patent: Mar. 3, 1992

[54] VENETIAN BLIND TILT WAND CONNECTOR

[75] Inventors: Robert N. King, Sunnyvale; Alan R. Sternquist, Pleasanton; Douglas J. Warner, Albany, all of Calif.

[73] Assignee: Levolor Corporation, Sunnyvale, Calif.

[21] Appl. No.: 682,489

[22] Filed: Apr. 9, 1991

[51] Int. Cl.[5] ..... E06B 9/26

[52] U.S. Cl. ..... 160/176.1; 160/178.1

[58] Field of Search ..... 160/176.1, 177, 178.1, 160/168.1, 173, 166.1

[56] References Cited

U.S. PATENT DOCUMENTS

| | | | |
|---|---|---|---|
| 3,918,513 | 11/1975 | Englund et al. | 160/176.1 |
| 4,141,402 | 2/1979 | Marotto | 160/176.1 |
| 4,406,319 | 9/1983 | McNiel et al. | 160/177 |
| 4,507,831 | 4/1985 | McClure | 160/177 X |
| 4,593,738 | 6/1986 | Chi Yu | 160/176.1 |
| 4,607,974 | 8/1986 | Brothers et al. | 160/178.1 X |
| 4,676,292 | 6/1987 | Valle et al. | 160/176.1 |
| 4,875,516 | 10/1989 | Marocco | 160/177 X |
| 5,002,113 | 3/1991 | Georgopoulos | 160/176.1 |

FOREIGN PATENT DOCUMENTS

| | | | |
|---|---|---|---|
| 2164986 | 4/1986 | United Kingdom | 160/178.1 |

*Primary Examiner*—David M. Purol
*Attorney, Agent, or Firm*—Skjerven, Morrill, MacPherson, Franklin & Friel

[57] ABSTRACT

A tilt wand (40)-to-tilt shaft (30) detachable connection in a venetian blind (10) having a series of tiltable slats (14) depending from a blind headrail (11) is provided by a U-shaped stiff wire or link (20). In one embodiment the distal free ends (22) of the U-shaped link (20) are ramp (25) snap-connected into bores (32) or a transverse through-aperture in the tilt shaft (30) which transmits wand torque through gearing (18, 19) to a blind ladder-tilting drum (17) in the headrail. The other bight end (21) of the link extends through a wand tip eye (41). Upon axial downward stress on the wand the ramped distal ends (22) of the link (20) will pull out of the bores (32) permitting disengagement of the link (20) and wand (40) from the tilt shaft (30) before any damage can be done to the gearing. In another embodiment distal end (52) of a link (50) is fixed in the tilt shaft (30) and a bight portion (53) of the link engaged to and disengageable from an open semi-eye (61) on the wand tip. In a third embodiment a cap (70) is fixedly attached to the link bight (53) and a wand tip (71) inserted in a cap bore (77) therein. A series of transverse and axial ribs and grooves in the cap bore and on the tip prevent relative rotation and transmit torque and provide a disengageable snap connection.

15 Claims, 3 Drawing Sheets

VENETIAN BLIND TILT WAND CONNECTOR

RELATED APPLICATIONS

This application relates to U.S. application Ser. No. 07/687,778 filed Apr. 9, 1991 entitled "WINDOW BLIND TILT WAND-TO-TILT SHAFT UNIVERSAL CONNECTOR", inventors: Robert N. King and Douglas J. Warner, assigned to the assignee hereof.

FIELD OF THE INVENTION

This invention is directed to a venetian blind where tilting of the horizontal blind slats is performed by hand rotation of a tilt wand which in turn rotates a tilt shaft having a gear end in engagement with a gear-driven tilt mechanism in the blind headrail. This in turn operates two or more tilt ladders supporting the slats. More particularly the invention is directed to an improved connection between the tilt wand and tilt shaft.

BACKGROUND OF THE INVENTION

Wand-operated tilt blinds are shown in Debs U.S. Pat. No. 3,921,965 where a tilt shaft with a threaded worm end rotates a gear-driven ladder drum to which legs of a tilt ladder are attached. Rotation of the wand causes rotation of the tilt shaft and the ladder drum and a resultant pulling of one of the ladder legs and slackening of the other ladder leg. This results in the tilting of a series of blind slats. The lower end of a typical tilt shaft contains a transverse through aperture into which a top portion of an S-shaped metal hook is inserted. An apertured upper end of the wand is inserted into a bottom portion of the hook as it is shown in Anderle U.S. Pat. No. 4,222,157. A separate plastic cylindrical sleeve is normally employed covering and holding the upper portion of the S-hook in the tilt shaft. While the above construction utilizing an S-hook have been extensively employed in commercial and residential venetian blinds for many years, they do not always function smoothly and can actually jam, over all angles of tilt wand use. Further, the bottom portion of the S-hook hangs down considerably from the blind headrail so as to be unsightly. This is seen in U.S. Pat. No. 5,002,113. Additionally, if the wand is shipped separate from the remainder of the blind, it is fairly difficult for the ultimate customer or installer to assemble the wand on the hook. Further, if the wand is pulled down axially from the headrail either inadvertently or by design, damage to the tilt shaft gear, the tilt drum gear, or the wand connector or even breakage of the wand itself quite probably is the result.

SUMMARY OF THE INVENTION

This invention provides a window blind tilt wand connector which includes a generally U-shaped stiff wire or link for connecting the lower end of the tilt shaft and the upper end of the tilt wand. One end of the U-shaped stiff end is mounted in the tilt shaft and the other end is directly or indirectly mounted to transmit torque from an attached tilt wand. In each embodiment the tilt wand is releasably disengageable from the tilt shaft by an axial pulling-away force on the tilt wand. In a first embodiment, the U-shaped stiff wire is in the form of a snap link having the distal free ends of the U-shaped link insertable into wire-receiving apertures in the tilt shaft with the bight (bent loop) portion of the link passing through and freely held in a closed eye in the wand upper tip. The tilt wand with the link attached is positioned generally in axial alignment with the tilt shaft and the distal ends of the link pushed along the tilt shaft, preferably in opposed shaft edge slots until the distal ends, which are spring flexed outward, are released so that they spring inwardly into removable engagement in the tilt shaft aperture(s).

In the event it is desired to remove the tilt wand from the tilt shaft for repacking the blind or to prevent unwanted tilting or adjustment of the blind slats or if a child or adult inadvertently pulls the wand axially outward from the headrail and tilt shaft, the distal ends of the snap link will be pulled out of the wire-receiving apertures in the tilt shaft and the snap link will be guided by provided ramp surfaces on the link distal ends and the edge slots on the tilt shaft for removal of the snap link and tilt wand together from the tilt shaft and the remainder of the blind.

In a second embodiment a particularly short length tilt shaft is provided where at least one of the distal ends of the U-shaped stiff wire is fixedly connected to the shaft by being inserted into a wire-receiving aperture in the tilt shaft. The end may actually be molded into the tilt shaft. The bight portion of the U-shaped stiff wire or link extends downwardly so the loop is at the bottom. The upper end of the tilt wand has a partially closed eye (a semi-eye) at its upper tip with the edges of the semi-eye opening forming a gap of less length than the diameter of the bight portion of the U-shaped stiff wire so that the tilt wand is snap-fitted over the bight portion via the semi-eye. The linkage attachment to the tilt shaft and all the tilt shaft is concealed in the blind headrail thus improving the aesthetics of the blind. The tilt shaft with its attached upper worm gear can be shortened resulting in material cost savings and less shaft twisting. Since the link is fixed to the tilt shaft there are no loose parts (such as the S-link in the prior art) so parts cannot be lost. The snap fit of the link bight into the semi-eye allows detachment of the tilt wand per se under excessive downward force without damaging the tilter gear mechanisms or the wand.

In a third embodiment a distal end(s) of the U-shaped stiff wire or link are fixed in a wire-receiving aperture(s) in the tilt shaft and the bight end of the wire affixed in a snap cap. The snap cap has an internal axial bore. Both the bore and the upper tip of the tilt wand have interfitting ribs and detents for preventing relative rotation of the tilt wand with respect to the snap cap and for snap-connecting the tilt wand to the snap cap. A connector is thus provided for transmission of tilt wand torque to the tilt shaft for the rotation of the tilt shaft and operation of the tilt mechanism and tilt blind slats. This embodiment also provides a linkage concealable in the headrail, permits use of a shorter tilt shaft without compromising the operation of the tilting mechanism, has no loose parts which could be lost, and provides for detachment of the wand from the cap under excessive downward force without damaging the tilter gear mechanisms or the wand.

DETAILED DESCRIPTION

Figure 1:
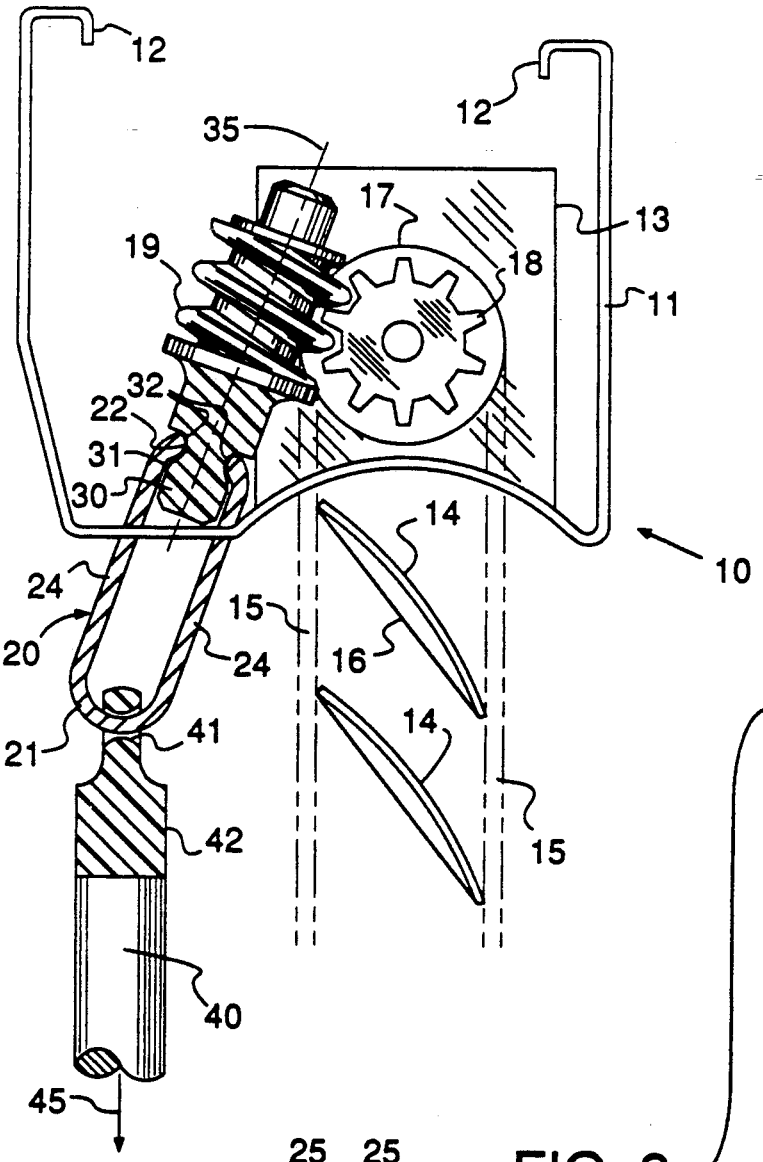
FIG. 1 is a schematic partial side view partially in section showing a blind incorporating the invention.

In FIG. 1, a venetian blind 10 includes an elongated horizontal headrail 11 which fits in or outside a window casement (not shown). The headrail comprises a metal or plastic housing typically including hook-like front and rear longitudinal edges 12 for mounting on a pair of brackets (not shown) affixed to the window frame. A series of horizontal blind slats 14 depend from the headrail and are supported by a pair or more of woven polyester tilt ladders having vertical ladder legs 15 and integral horizontal tilt rungs 16 extending under each slat. The upper ends of ladder legs 15 are typically tang-affixed to opposite sides of a rotatable tilt drum 17 in a drum housing 13, the drum being rotated by rotation of an end gear 18 actuated by a worm gear 19 on the end of a tilt shaft 30. The tilt shaft is rotated by manual torquing of a tilt wand 40 connected by the connector 20.

The connector 20 is a U-shaped stiff wire or snap link with distal free ends 22 which seat or snap into through-aperture or a pair of partial bores 32 in the tilt shaft 30. The legs 24 of connector 20 extend through an aperture in the bottom of headrail 11 and the curved or bight opposite end portion 21 of the connector wire passes through a transverse aperture or eye 41 in the tip 42 of wand 40 so that the connector is essentially in a non-rotative relation to the tilt wand. Manual torquing of the wand in one or the other rotational direction and over a fairly wide range of angular positions rotates the connector 20, the tilt shaft 30 and in turn the tilt drum 17, to effect a pulling or slacking of the opposite tilt ladder legs affixed to the drum and resultant tilting of the slats supported and carried by the cross rungs 16 to a slats open or slats closed position.

Figure 2:
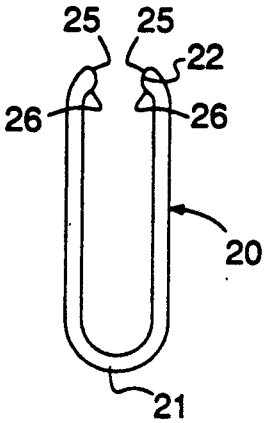
FIG. 2 is a side elevational view of the U-shaped stiff wire.
Figure 3:
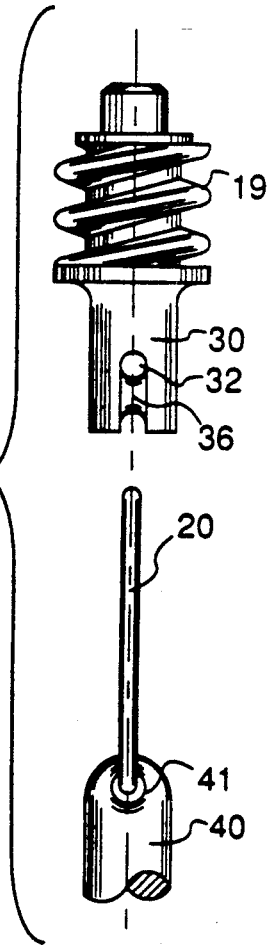
FIG. 3 is an exploded view of the tilt shaft, U-shaped link and wand taken 90° from the view in FIG. 1.

The connector 20 is seen in more detail in FIG. 2 particularly the curved distal ends 22. Each of these ends has an inside upper ramp curved surface 25 which guidingly facilitates assembly of the connector on the lower peripheral surface 31 of the tilt shaft and an inside lower ramp curved surface 26 which allows the connector to disengage from the tilt shaft 30 when an axial pulling force (arrow 45) is applied to wand 40 either by accident or design. Without this disengagement feature such axial force performed, for example, by someone strongly pulling down on the wand, likely would cause damage to the gear 19 or gear 18 or wand 40. As seen in FIG. 3, the side surface 31 of the tilt shaft includes a pair of oppositely disposed grooves or edge slots 36 extending parallel to the tilt shaft longitudinal axis 35. These edge slots function to guide and facilitate pushing of the connector distal ends 22 into bores 32. The edge slots 36 are aligned with the transverse bore(s) 32 of the tilt shaft. The legs 24 of the snap link have a sufficient flex from the bight portion so that the ramp surface 25 tends to expand the legs slightly opening the U-shape. When the distal ends reach the through-aperture or bores 32 the distal ends spring back toward each other and snap into the opposed bores 32. Disengagement by downward axial force on the wand results in ramp surfaces 26 allowing the distal free ends to move slightly outwardly expanding the U-opening to that the distal ends slide down edge slots 36 to a location where there is complete separation of the connector (and the wand) from the tilt shaft. This embodiment while having a portion of the connector exposed below the headrail provides a short tilt shaft entirely within the headrail with resulting material cost savings.

Figure 4:
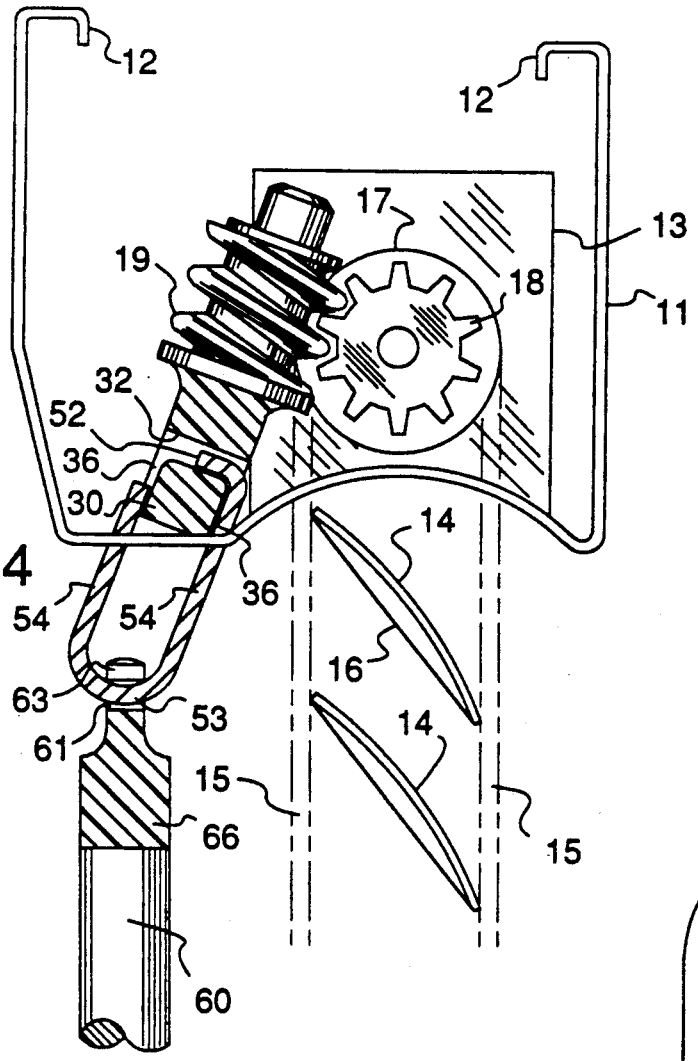
FIG. 4 is a schematic side view partially in section showing a second embodiment of the invention.
Figure 6:
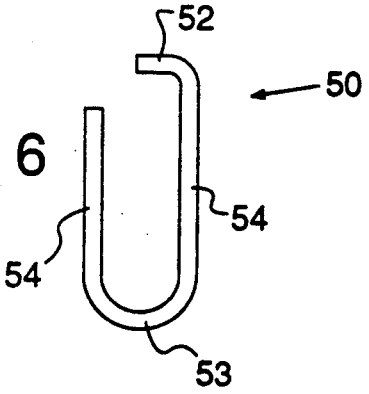
FIG. 6 is a side view of the link of the second embodiment.
Figure 5:
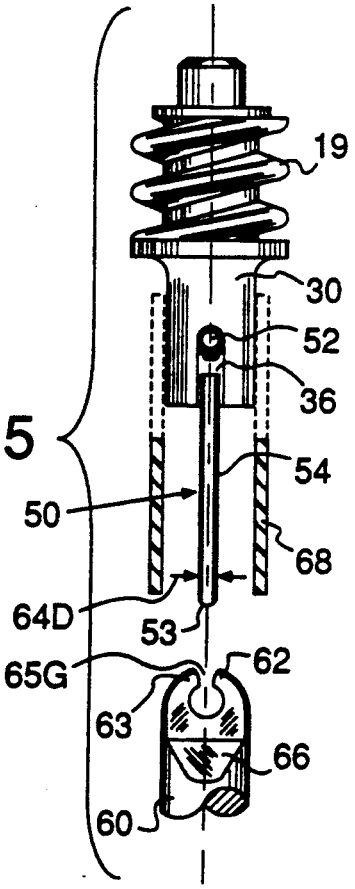
FIG. 5 is an exploded view of the tilt shaft, U-shaped link and wand taken 90° from the view of the second embodiment in FIG. 4.
Figure 7:
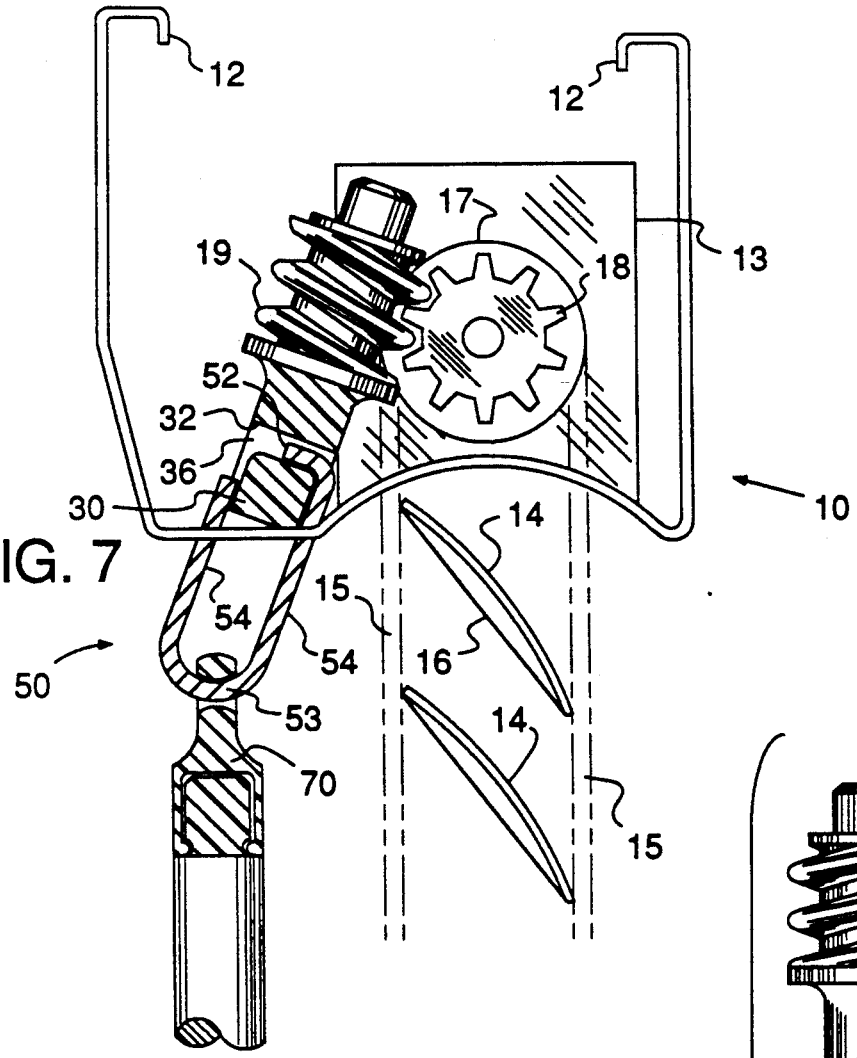
FIG. 7 is a schematic partial side view partially in section showing a third embodiment of the invention.
Figure 10:
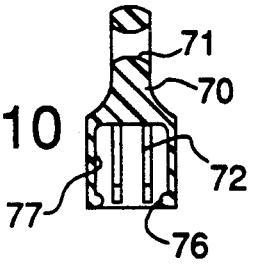
FIG. 10 is a cross-section view of the cap of the FIG. 7 embodiment.
Figure 9:
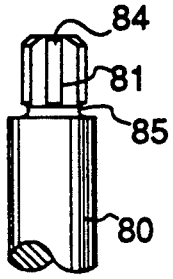
FIG. 9 is a side view of the tilt wand end of the FIG. 7 embodiment.
Figure 8:
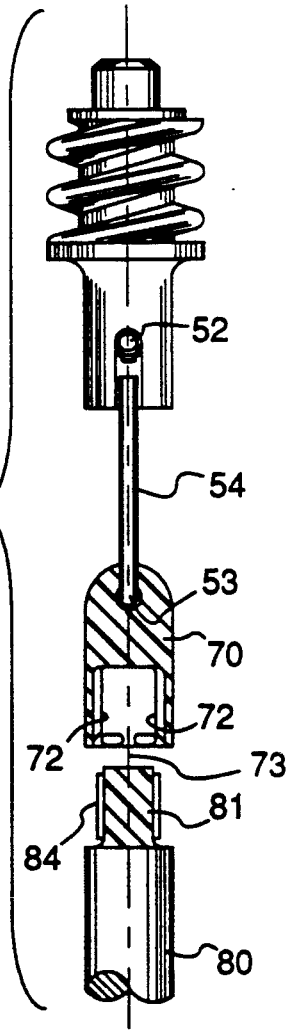
FIG. 8 is a front view partially in cross-section of the tilt shaft wand connection of FIG. 7.

FIGS. 4 and 5 show a second embodiment in which a connector 50 also in the form of a U-shaped stiff wire or link 51 is fixedly connected by a distal end tail portion 52 extending just beyond halfway through an aperture 32 of tilt shaft 30. The tilt shaft may be of the same construction as the tilt shaft in the FIG. 1 embodiment. The tilt shaft is typically constructed of nylon, polycarbonate or acetal-type polymers commonly available in the plastic industry. The wand 60 normally made of butyrate or acrylic plastic has an upper tip portion 60 having bifurcated ends 62, 63 forming a semi-eye 61 therebetween. The gap 65G between ends 62 and 63 is less by about 0.7 mm than the diameter 64D of the U-shaped connector link 50. This permits the wand tip 66 to be forced over the bight 53 of the connector link 50 resulting in the bight being recessed in semi-eye 61. The legs 62, 63 are capable of sufficient flex with respect to the remainder of the wand tip 66 to allow bight 53 to enter the semi-eye. Again if there is an accidental or other axial down pull on the wand, the wand eye gap 65G will open allowing the wand to separate from connector 50 and the tilt shaft before any damage can be done to gear 19 or gear 18. Each side edge 36 of the tilt shaft acts to facilitate the entry and fixing of the connector 50 onto the tilt shaft and also functions to transmit the torque from the wand 60 by the manual rotary manipulation of the wand by a user desiring to tilt the blind slats. Torque is also transmitted from the transverse wand eye to the bight extending transversely through the eye. The legs 54 of the link fit in the side edge slots or grooves 36 which also aids in transmitting torque to the tilt shaft. Optionally a plastic sleeve 68 typically of nylon plastic may be employed which is slidable upward to the dashed portion to more securely hold the connector link in the tilt shaft. The link 50 may also have short distal tail portions on each of legs 54 which fixedly fit into opposite sides of the tilt shaft through aperture 32.

FIGS. 7–10 illustrate a third embodiment which utilizes the same tilt shaft 30 and connector link 50 as in the second embodiment. A cap 70 is fixedly attached to or molded around the bight 53 the link 50 and has an internal bore 51. The bore 51 and a wand tip 81 include a series of ridges and detents which prevent relative rotation of the cap and a wand 80 and provide a snap connection therebetween. A first set of parallel ridges or ribs 72 extend parallel to the longitudinal axis 73 of the cap and a matching interfitting series of ridges or ribs 84 are provided on the wand tip. A circular groove 85 on the base of the wand tip and a circularly oriented number of detents 76 in the cap bore provide a snap connection onto groove 85.

The above description of embodiments of this invention is intended to be illustrative and not limiting. Other embodiments of this invention will be obvious to those skilled in the art in view of the above disclosure.

We claim:

1. A window venetian blind having a horizontal headrail, a series of tiltable horizontal slate depending from said headrail, a tilt wand extending in a generally vertical downward directional position from said headrail, a gear assembly in said headrail and operable by said tilt wand to tilt said slats, a tilt shaft extending from said assembly and a connector for torque-connecting said tilt wand to said tilt shaft;

wherein said tilt shaft includes a gear at an upper end in geared engagement with said gear assembly and a wire-receiving aperture below said gear;

said connector comprising a generally U-shaped stiff wire having at least one end insertable into said wire-receiving aperture;

means on said tilt wand for mounting an opposite end of said wire in non-rotative relation to said tilt wand; and means associated with said wire and said wand for releasably disengaging said tilt wand from said tilt shaft when said tilt wand is in its generally vertical downward directional position by axial break-away movement of said tilt wand from said tilt shaft.

2. The blind of claim 1 wherein the U-shaped stiff wire includes at least one distal end fixed in said wire-receiving aperture, and wherein said tilt wand includes an upper tip having a bifurcated flex end, said bifurcated end having an upper opening normally less in width than a diameter of a bight end of said U-shaped stiff wire such that the tilt wand is snap-fitted on said bight end of said U-shaped stiff wire.

3. The blind of claim 2 wherein said at least one distal end of said U-shaped stiff wire includes an inwardly facing tip fixedly insertable into said wire-receiving aperture, said tilt shaft including at least one edge slot aligned with said wire-receiving aperture and extending from said aperture toward the opposite end of the U-shaped stiff wire, and wherein at least one of the U-shaped stiff wire legs seats into said at least one edge slot to prevent rotation of said U-shaped stiff wire with respect to said tilt shaft when rotation of said tilt wand rotates said U-shaped stiff wire and said tilt shaft.

4. The blind of claim 3 wherein said tilt shaft opposite end terminates within said headrail and only said bight end of said U-shaped stiff wire depends from said headrail.

5. The blind of claim 1 wherein the U-shaped stiff wire has at least one distal free end fixed in said wire-receiving aperture and wherein said means for mounting an opposite end of said U-shaped stiff wire includes a snap cap fixed on a bight end of said U-shaped stiff wire for receiving an upper tip of said tilt wand, said snap cap having a distal end bore including means in said snap cap bore for preventing relative rotation with said tilt wand while transmitting torque from rotation of said tilt rod to said snap cap, to said stiff wire and to said tilt shaft.

6. The blind of claim 5 in which said means for releasably disengaging said tilt wand comprises means in said snap cap bore and said tilt wand upper tip for snap connecting said tilt wand to said snap cap.

7. A window venetian blind having a headrail, a series of tiltable horizontal slats, a tilt wand, a gear assembly in said headrail and operable by said tilt wand, a tilt shaft extending from said assembly and a connector for torque-connecting said tilt wand to said tilt shaft;

wherein said tilt shaft includes a gear at an upper end in geared engagement with said gear assembly and a wire-receiving aperture below said gear;

said connector comprising a generally U-shaped stiff wire having at least one end insertable into said wire-receiving aperture;

means on said tilt wand for mounting an opposite end of said wire in non-rotative relation to said tilt wand;

means associated with said wire and said wand for releasably disengaging said tilt wand from said tilt shaft by axial break-away movement of said tilt wand; and wherein the U-shaped stiff wire is a snap link having distal free ends, each free end being removably engageable in and disengageable from oppositely spaced wire-receiving apertures in said tilt shaft.

8. The blind of claim 7 wherein said means on said tilt wand comprises a bight portion of said snap link medially positioned between said distal free ends, said tilt wand including an eye through which said link bight portion extends, and wherein said tilt shaft includes a pair of edge slots extending parallel to the longitudinal axis of the tilt shaft and aligned with respective ones of said snap link distal free ends and wire-receiving apertures, such that axial movement of said wand in assembled condition away from said tilt shaft separates said wand and said snap link from said tilt shaft, the distal free ends of said snap link being pulled out of the wire-receiving apertures and being guided by said edge slots.

9. The blind of claim 8 wherein said snap link distal free ends are inwardly curved and wherein each of said wire-receiving apertures includes a ramp surface extending toward a bottom end of said tilt shaft opposite said tilt shaft upper end, each said ramp surface being aligned with one of said pairs of edge slots.

10. The blind of claim 9 in which said tilt shaft bottom end is bifurcated to guide said snap link distal ends into said edge slots, said ramps and said wire-receiving apertures when said snap link and tilt wand are being assembled on said tilt shaft.

11. The blind of claim 10 in which said wire-receiving apertures comprise a through-aperture transverse to the longitudinal axis of said tilt shaft.

12. A window venetian blind having a headrail, a series of tiltable horizontal slats, a tilt wand, a gear assembly in said headrail and operable by said tilt wand, a tilt shaft extending from said assembly and a connector for torque-connecting said tilt wand to said tilt shaft;

wherein said tilt shaft includes a gear at an upper end in geared engagement with said gear assembly and a wire-receiving aperture below said gear;

said connector comprising a generally U-shaped stiff wire having at least one end insertable into said wire-receiving aperture;

means on said tilt wand for mounting an opposite end of said wire in non-reactive relation to said tilt wand;

means associated with said wire and said wand for releasably disengaging said tilt wand from said tilt shaft by axial break-away movement of said tilt wand;

wherein the U-shaped stiff wire has at least one distal free end fixed in said wire-receiving aperture and wherein said means for mounting an opposite end of said U-shaped stiff wire includes a snap cap fixed on a bight end of said U-shaped stiff wire for receiving an upper tip of said tilt wand, said snap cap having a distal end bore including means in said snap cap bore for preventing relative rotation with said tilt wand while transmitting torque from rotation of said tilt rod to said snap cap, to said stiff wire and to said tilt shaft; and wherein said means in said snap cap bore includes a series of internal ribs extending longitudinally of said bore and wherein said tilt wand upper tip includes a series of external ribs extending longitudinally of said wand upper tip interfitting with said cap bore ribs to prevent relative rotation of said cap and said tilt wand.

13. The blind of claim 12 in which said cap bore includes a second rib extending around said cap bore and wherein said tilt wand upper tip includes an exterior peripheral ridge having an outer diameter greater than the internal diameter of said second rib such that said tilt rod in snap-connectable to said snap cap.

14. The blind of claim 12 in which said means for releasably disengaging said tilt wand comprises a circular detent in said snap cap bore and said tilt wand upper tip includes a peripheral groove, said peripheral groove being snap-connectable to said snap cap detent.

15. A window venetian blind having a headrail, a series of tiltable horizontal slats, a tilt wand, a gear assembly in said headrail and operable by said tilt wand, a tilt shaft extending from said assembly and a connector for torque-connecting said tilt wand to said tilt shaft;

wherein said tilt shaft includes a gear at an upper end in geared engagement with said gear assembly and a wire-receiving aperture below said gear;

said connector comprising a generally U-shaped stiff wire having at least one end insertable into said wire-receiving aperture;

means on said tilt wand for mounting an opposite end of said wire in non-rotative relation to said tilt wand; and means associated with said wire and said wand for releasably disengaging said tilt wand from said tilt shaft by axial break-away movement of said tilt wand;

wherein the U-shaped stiff wire has at least one distal free end fixed in said wire-receiving aperture and wherein said means for mounting an opposite end of said U-shaped stiff wire includes a snap cap fixed on a bight end of said U-shaped stiff wire for receiving an upper tip of said tilt wand, said snap cap having a distal end bore including means in said snap cap bore for preventing relative rotation with said tilt wand while transmitting torque from rotation of said tilt rod to said snap cap, to said stiff wire and to said tilt shaft;

wherein said means in said snap cap bore includes a series of internal ribs extending longitudinally of said bore and wherein said tilt wand upper tip includes a series of external ribs extending longitudinally of said wand upper tip interfitting with said cap bore ribs to prevent relative rotation of said cap and said tilt wand;

in which said means for releasably disengaging said tilt wand comprises means in said snap cap bore and said tilt wand upper tip for snap connecting said tilt wand to said snap cap; and in which said means for snap connecting comprises an interfitting groove and detent on respective interfitting surfaces of said wand upper tip and snap cap bore.

* * * * *

UNITED STATES PATENT AND TRADEMARK OFFICE

CERTIFICATE OF CORRECTION

PATENT NO. : 5,092,387
DATED : March 3, 1992
INVENTOR(S) : Robert N. King, Alan R. Sternquist and Douglas J. Warner

It is certified that error appears in the above-identified patent and that said Letters Patent is hereby corrected as shown below:

Col. 1, line 34, "4,222,157" should read --4,222,156--.

Signed and Sealed this

Ninth Day of November, 1993

*Attest:*

*Attesting Officer*

BRUCE LEHMAN

*Commissioner of Patents and Trademarks*